US007175250B2

(12) United States Patent
Nimura

(10) Patent No.: US 7,175,250 B2
(45) Date of Patent: Feb. 13, 2007

(54) PRINTING SYSTEM AND PRINT CONTROLLER

(75) Inventor: Kazunobu Nimura, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 287 days.

(21) Appl. No.: 10/885,886

(22) Filed: Jul. 8, 2004

(65) Prior Publication Data

US 2005/0057592 A1 Mar. 17, 2005

(30) Foreign Application Priority Data

Jul. 8, 2003 (JP) ..... P. 2003-193725

(51) Int. Cl.
*B41J 29/393* (2006.01)

(52) U.S. Cl. ..... 347/19

(58) Field of Classification Search ..... 347/19, 347/15, 43

See application file for complete search history.

(56) References Cited

U.S. PATENT DOCUMENTS 6,196,663 B1 * 3/2001 Wetchler et al. ..... 347/43

2002/0033859 A1 * 3/2002 Mitsuzawa et al. ..... 347/23

FOREIGN PATENT DOCUMENTS

JP 8-251363 A 9/1996

* cited by examiner

*Primary Examiner*—Lamson Nguyen
(74) *Attorney, Agent, or Firm*—Sughrue Mion, PLLC

(57) ABSTRACT

A printing system for performing a printing operation by using a black recording agent and color recording agents, includes: a detecting unit that detects a remaining amount of each of the recording agents; and a printing unit that prints, when the remaining amount of the black recording agents reaches a first threshold value for warning a user against that the remaining mount of the black recording agent is decrease while an printing operation can be carried out in the printing system, data to be printed by using the color recording agents.

17 Claims, 3 Drawing Sheets

PRINTING SYSTEM AND PRINT CONTROLLER

BACKGROUND OF THE INVENTION

The present invention relates to a technique for printing an object to be printed by a black recording agent by using a color recording agent when the remaining amount of the black recording agent decreases in a printer capable of performing a color printing operation.

In an ink jet printer capable of performing a color printing operation, a print control method is known that when black ink is used up during a printing operation, the printing operation is temporarily interrupted, and when the printing operation using composite black obtained by overprinting color inks is permitted, the printing operation is resumed by the composite black (for instance, see JP-A-8-251363).

Here, in order to maintain the printing performance of the ink jet printer, the maintenance of a recording head, for instance, a cleaning operation is preferably carried out. When the recording head is cleaned, the ink is consumed. Accordingly, even when the printing operation is not carried out, a certain amount or more of ink preferably remains in an ink cartridge.

However, the JP-A-8-251363 only discloses that when the black ink is completely used up, the black ink shifts to the composite black.

SUMMARY OF THE INVENTION

It is an object of the present invention to provide a technique by which while a recording agent necessary for maintenance is assured, a printing operation can be continuously carried out.

In order to solve the aforesaid object, the invention is characterized by having the following arrangement.

(1) A printing system for performing a printing operation by using a plurality of various recording agents, comprising;

a detecting unit that detects a remaining amount of each of the plurality of various recording agents; and a printing unit that prints, if the remaining amount of a first one of the plurality of various recording agents is not higher than a first threshold value for warning a user against that the remaining amount of the first one is decreased, data to be printed by using second one or ones of the plurality of various recording agents other than the first one, wherein the first threshold value allows the printing system to carry out an printing operation.

(2) The printing system according to (1), wherein the detecting unit monitors the remaining amount of each of the plurality of various recording agents, and when the detecting unit detects that the remaining amount of the first one reaches or is not higher than the first threshold value, the printing unit prints the data to be printed.

(3) The printing system according to (1), wherein the first one is a black recording agent and the second one or ones are color recording agents.

(4) The printing system according to (3), wherein if the detecting unit detects that the remaining amount of one of the plurality of the color recording agents is not higher than a second threshold value when printing using color recording agents substituting for black recording agent, the printing unit prints the data to be printed by using the black recording agent.

(5) The printing system according to (1), wherein the printing system performs a maintenance consuming the plurality of various recording agents.

(6) The printing system according to (4), wherein the printing system performs a maintenance consuming the plurality of various recording agents.

(7) The printing system according to (1) further comprising:

a displaying unit that displays a screen for inquiring a user about whether or not the data to be printed by using the first one is printed by using the second ones without using the first one if the remaining amount of the first one is not higher than the first threshold value, wherein when an instruction for printing the data by using the second ones without using the first one is received, the print data generating unit generates the print data for printing the data to be printed by using the first one by using the second ones without using the first one.

(8) The printing system according to (1), the detecting unit further detects a third threshold value, wherein the remaining amount of the recording agent at the third threshold value is lower than that at the first threshold value, wherein the third threshold value prohibits the printing system from carrying out an printing operation.

(9) A printer controller for controlling a printer for performing a printing operation by using a plurality of various recording agents, comprising:

an obtaining unit that obtains from the printer information showing a remaining amount of each of the plurality of various recording agents; and a print data generating unit that generates, if the remaining amount of first one of the plurality of various recording agents is not higher than a first threshold value for warning a user against that the remaining mount of the first one is decreased, print data to be printed by using second one or ones of the plurality of various recording agents other than the first one, wherein the first threshold value allows the printer to carry out an printing operation.

(10) The printer controller according to (9), wherein the detecting unit monitors the remaining amount of each of the plurality of various recording agents, and when the detecting unit detects that the remaining amount of the first one reaches or is not higher than the first threshold value, the printer prints the data to be printed.

(11) The printer controller according to (9), wherein the first threshold value is larger than a second threshold value as a lower limit of the remaining amount of the first one in which the printer can perform the printing operation, when the remaining amount of the first one is not higher than the first threshold value and not lower than the second threshold value, the print data generate unit generates the print data by using the second ones without using the first one for the data to be printed by using the first one.

(12) The printer controller according to (9), wherein the first one is a black recording agent and the second one or ones are color recording agents.

(13) A printer controller according to (9), wherein the first threshold value is determined on the basis of a difference between the remaining amount of the black recording agent and the remaining amount of the color recording agents.

(14) The printer controller according to (9) further comprising:

a displaying unit that displays a screen for inquiring a user about whether or not the data to be printed by using the first one is printed by using the ones without using the first one when the remaining amount of the first one reaches the first threshold value;

wherein when an instruction for printing the data by using the second ones without using the first one is received, the print data generating unit generates the print data for printing the data to be printed by using the first one by using the second ones without using the first one.

(15) A printer control method of controlling a printer for performing a printing operation by using a black recording agent and a plurality of color recording agents, the printer control method comprising steps of:

obtaining from the printer information showing a remaining amount of each of the plurality of various recording agents; and generating, if the remaining amount of a first one of the plurality of various recording agents reaches a first threshold value for warning a user against that the remaining mount of the first one is decrease, print data to be printed by using second ones of the plurality of various recording agents other than the first one, wherein the first threshold value allows the printer to carry out an printing operation.

(16) A computer readable recording medium that stores a computer program for a printer control, the computer program causing a computer comprising to execute the steps of:

obtaining from the printer information showing a remaining amount of each of the plurality of various recording agents; and generating, if the remaining amount of a first one of the plurality of various recording agents reaches a first threshold value for warning a user against that the remaining mount of the first one is decreased while an printing operation can be carried out in the printing system, print data to be printed by using second ones of the plurality of various recording agents other than the first one.

(17) The computer readable recording medium according to (16) further comprising the step of:

transmitting the generated print data to the printer to perform the printing operation.

DETAILED DESCRIPTION OF PREFERRED EMBODIMENTS

Figure 1:
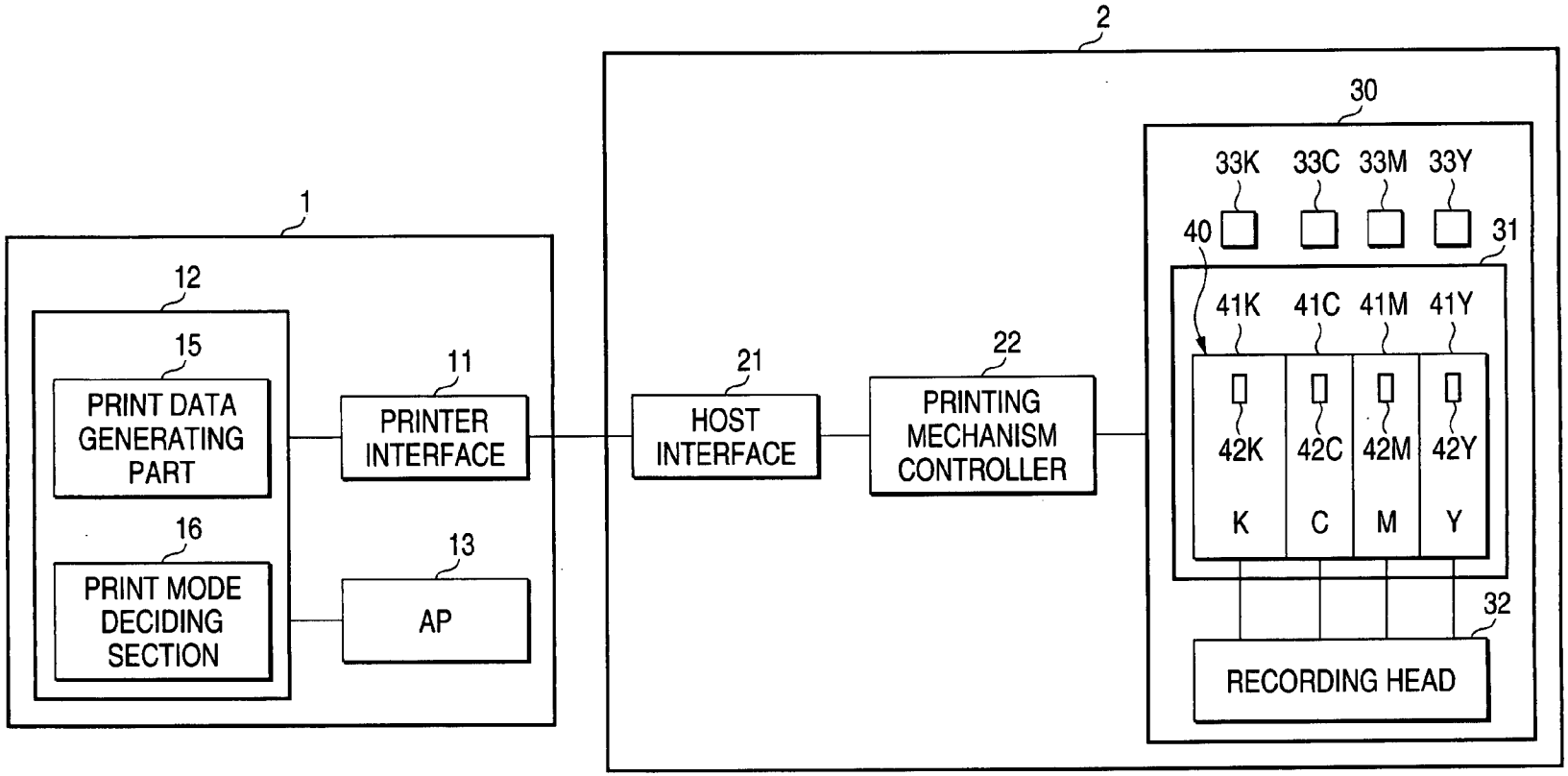
FIG. 1 is a diagram showing the structure of a printing system according to one embodiment to which the present invention is applied.

Now, one embodiment according to the present invention will be described with reference to the accompanying drawings. FIG. 1 is a diagram of an entire structure of a printing system according to the embodiment of the present invention. The printing system includes a host device 1 for controlling a printer and the printer 2 for performing a printing operation on a printing medium by using a recording agent such as ink or toner.

The host device 1 is generally a general-purpose computer such as a personal computer. The functions and structures provided in the host device 1 described hereinafter are respectively realized, for instance, by executing a predetermined installed computer program. For instance, in the host device 1, a printer driver functioning as a print controller is realized.

In the embodiment described below, the printer 2 jets ink to the printing medium such as a printing sheet to form an image. An ink jet printer capable of performing a color printing operation is described as an example, and the printing system according to the invention may be applied to a copying machine or a printing system in a copying system.

As shown in FIG. 1, the host device 1 includes an interface part 11 to the printer, a printer driver 12 and an application program (AP) 13. In FIG. 1, the host device 1 is connected to the printer 2 through the printer interface 11.

The printer interface 11 is connected to a host interface 21 of the printer 2 side through wire or wireless communication system. A communication is performed in accordance with a predetermined protocol. The printer interface 11 transmits print data to the printer 2 or receives various information concerning the printer such as an amount of use of ink or the remaining amount of ink from the printer 2.

The host device 1 performs the predetermined program so that the AP 13 is realized on the host device 1. In the host device 1, a plurality of APs 13 can be performed. The AP 13 supplies data such as an image or a text to the printer driver 12 to request for printing.

The printer driver 12 transmits various kinds of commands to the printer 2 to control the printer. The printer driver 12 includes a print data generating part 15 and a print mode deciding section 16. The print data generating part 15 generates print data on the basis of a print request from the AP 13. The generated print data is transmitted to the printer 2 through the printer interface 11 to perform a printing operation.

There is a case the print request from the AP 13 designates either a color printing for printing by using a color ink or a black-and-white printing for printing using only a black ink. When the color printing is designated by the print request from the AP 13, the print data generating part 15 generates the color print data for performing the printing operation by using the color ink. When the black-and-white printing is designated, the print data generating part 15 generates the black-and-white print data for performing the printing operation using the black ink. The color print data is generated with reference to, for instance, a color printing LUT (a look up table) to generate the color print data for forming the image or the text by the color inks including C (cyan), M (magenta), Y (yellow), etc. For instance, when the print request for printing by using only the black ink is received, the black-and-white print data for forming the text or the image by the black ink is generated with reference to, for instance, a black-and-white printing LUT. In principle, the print data generating part 15 generates the print data as designated by the print request as described above. This is called a normal mode.

However, for instance, when the black-and-white printing is designated, if the black ink is insufficient, the host device 1 may allow the printer 2 to perform the printing operation by a color (composite black) near to black obtained by overprinting the color inks in place of the black ink. This is called a composite black mode.

In composite black mode, when the black-and-white printing is designated by the print request, the print data generating part 15 generates the color print data for performing the printing operation by the composite black using the color inks on the basis of the data to be printed by using the black ink. For instance, when the printer 2 is provided with C, M and Y as the color inks, the print data generating part 15 generates print data to be printed by overprinting C, M and Y respectively for the data to be printed using the black ink.

The print mode deciding section 16 decides whether the printing operation is performed under the normal mode or the printing operation is performed under the composite black mode. For instance, the print mode deciding section 16 carries out a decision in accordance with the remaining amount of ink included in an ink cartridge 40 mounted on the printer 2 to determine a print mode. For instance, the print mode deciding section 16 obtains the ink control information of the black ink and the color inks from the printer 2 and decides the print mode on the basis of the ink control information to specify the print mode. When the print mode is specified by deciding the print mode, the print data generating part 15 is informed of the specified print mode. The ink control information may be obtained and the print mode may be decided for each of the print requests (a print job). The detailed procedure of a deciding process for deciding the print mode is described below.

The printer 2 is connected to the host device 1 through the host interface 21. The printer 2 includes a printing mechanism 30 for actually performing a printing process and a printing mechanism controller 22 for controlling the printing mechanism. The printing mechanism controller 22 includes, for instances a processor (not shown) for performing various kinds of programs and a memory (not shown) for recording the programs and data. This memory may be, for instance, an EEPROM and a RAM or the like.

The printing mechanism 30 includes, for instance, a recording head 32, a sheet feed mechanism (not shown) and a control circuit (not shown) for controlling them. The printing mechanism 30 further includes amounting part 31 for detachably mounting the ink cartridge 40 in which the ink is contained.

When the ink cartridge 40 is mounted on the mounting part 31, the recording head 32 jets the ink supplied from the ink cartridge 40 to form an image on the printing medium.

The ink cartridge 40 detachably attached to the mounting part 31 includes containers 41 (41C, 41M, 41Y, 41K) for respectively containing the inks, for instance, C (cyan), M (magenta), Y (yellow) and K (black). Each of the inks C, M and Y may be generally called color ink. The containers 41 respectively include memory elements 42 (42C, 42M, 42Y, 42K). Each of the memory elements 42 may be, for instance, a semiconductor element such as an IC (an integrated circuit) In each of the memory elements 42, the ink control information showing, for instance, the model number of the ink cartridge 40, the remaining amount of each of the color inks (or an mount of use) or the like is stored. The ink control information is stored in the memory elements 42C, 42M, 42Y, and 42K respectively corresponding to the inks.

The printing mechanism 30 further includes a reader/writer 33 (33C, 33M, 33Y, 33K) for reading data stored in each of the memory elements 42 and writing data when the ink cartridge 40 is mounted on the mounting part 31. The readers/writers 33C, 33M, 33Y and 33K read out or update the ink control information stored in the memory elements 42C, 42M, 42Y and 42K respectively corresponding thereto.

The ink cartridge 40 may be a four-cartridge type cartridge in which the containers 41 are respectively formed as separate bodies. The ink cartridge 40 may be one-cartridge type in which all the containers 41 are integrally formed, or a two-cartridge type in which the containers 41C, 41M and 41Y are formed integrally and the container 41K is formed separately therefrom. Further, one memory element 42 may be provided for one cartridge. That is, in the case of the one cartridge type, the memory elements 42C, 42M, 42 Y and 42K may be constituted by one memory element. In the case of the two-cartridge type, the memory elements 42C, 42M and 42Y may be constituted by one memory element, and the memory element 42K may be constituted by one memory element. At this time, the readers/writers 33 may be provided so as to correspond to the memory elements 42.

In this embodiment, the remaining amount of ink of each container 41 can be recognized by referring to the ink control information. In addition thereto, for instance, a sensor for detecting the remaining amount of ink may be provided to detect the remaining amount of the ink.

In this printer 2, the ink in each of the containers 41 may be consumed even when the ink is not used for printing. This phenomenon occurs, because the printer 2 suitably (for, example, periodically) performs a cleaning operation of the recording head 32 in order to prevent an ink nozzle from clogging. The printer 2 automatically performs a cleaning operation of the recording head 32 for maintenance to maintain its normal operation.

The recording head 32 is cleaned in such a way that for instance, a cleaning motor provided in the printing mechanism 30, which is not shown in the drawings, sucks up the ink nozzles of all colors at the same time and sucks out inks from all the nozzles. Accordingly, since a little ink is consumed by the cleaning operation, the ink cartridge always requires a certain degree or more of ink.

Now, an operation of the printing system having the above-described structure will be described below.

The printer driver 12 transmits an ink control information obtaining request to the printer 2 through the printer interface 11 in order to grasp the remaining amount of the ink of each container 41. The ink control information obtaining request may be made, for instance, every time the print request is received from the AP 13, or for each page unit.

In the printer 2, when the printing mechanism controller 22 receives the control information obtaining request through the host interface 21, the printing mechanism controller instructs each reader/writer 33 to read out ink control information from each memory element 42. When the printing mechanism controller 22 obtains the ink control information of the ink of each color that each reader/writer 33 reads from each memory element 42, the printing mechanism controller 22 transmits the ink control information to the host device 1 through the host interface 21.

When the printer driver 12 receives the ink control information of each color through the printer interface 11, the print mode deciding section 16 decides the print mode.

When the print mode deciding section 16 decides the print mode, the print mode deciding section checks the remaining amount of ink. Since there are a plurality of types in threshold values used for checking the remaining amount of ink, these threshold values will be firstly described.

The first threshold value represents a threshold value for deciding the end of ink or not. The end of ink is a lower limit of an amount of ink that the printer can use the ink of that color to perform a printing operation. Accordingly, when the remaining amount of the ink is not higher than the end of ink, the printer 2 may be set so that the printer cannot perform the printing operation by using at least the ink or all the operations of the printer 2 may be stopped until the ink cartridge having the end of ink is replaced by a new ink cartridge.

The second threshold value is a threshold value showing an amount of ink that is larger than the end of ink and is a near end showing that the remaining amount of ink comes near to the end. The near end may be set to an amount of ink by which the predetermined number of sheets can be printed, for instance, when an average printing operation is performed (for instance, 40 sheets). Alternatively, the near end may be set to a remaining amount of ink of 5% as much as the whole of the container or 10% as much as the whole of the container. Especially, since the capacity of the container of the black ink is ordinarily larger than the capacity of the container of the ink of each of C, M and Y, the near end of the black ink may be set to 5% and the near end of the ink of each of C, M and Y may be set to 10%.

Further, the printer driver 12 may dynamically determine the near end on the basis of the difference between the remaining amount of the black ink and the remaining amount of the color ink. A near end predetermined on the basis of the difference of the remaining amount of ink may be supplied to the printer driver 12. For instance, when the difference between the remaining amount of the black ink and the maximum remaining amount of ink of the remaining amounts of the color inks is a predetermined amount or more, the near end of black is set to A. On the other hand, when the remaining amount of the black ink and the maximum remaining amount of the ink of the remaining amounts of the color inks is smaller than the predetermined amount, the near end of the black may be set to B smaller than A.

The above-described end and the near end may be individually determined for each of the inks.

Now, a print mode decision carried out by the print mode deciding section 16 will be described by using a flowchart shown in FIG. 2. The print mode deciding section 16 grasps the remaining amount of ink of each of the inks on the basis of the ink control information of each ink. Then, the print mode deciding section 16 decides whether or not the remaining amount of ink of the inks of C, M, Y and K is not higher than the end of ink (S11). If one of the inks reaches the end of ink or lower (S11: yes), a procedure is completed without performing a printing operation.

When there is no ink that reaches the end of ink or lower (S11: No), the print mode deciding section 16 decides whether or not a currently received print request is a black-and-white printing (S12). When the print request is not the black-and-white printing (S12: o), the print mode deciding section 16 decides the print mode to be a normal mode and informs the print data generating part 15 of it. Then, the print data generating part 15 generates print data in the normal mode and transmits the formed print data to the printer 2 to perform the printing operation (S17).

Then, the print request is the black-and-white printing (12: Yes), the print mode deciding section decides whether or not the black is reaches the near end or lower (S13). When the black ink does not reach the near end or lower (S13: No), the printing operation is carried out in the normal mode in accordance with the same procedure as described above (S17).

When the black ink reaches the near end or lower (S13: Yes), the print mode deciding section decides which of the color inks reaches the near end or lower (S14). When any one of the color inks reaches the near end or lower (S14: Yes), the printing operation is carried out in the normal mode by the same procedure as described above (S17). The step S14 may be omitted.

When any of the color inks does not reach the near end or lower (S14: No), the host device 1 allows a window for inquiring a user about whether or not the printing operation is carried out by composite black on a display device not shown in the drawing (S15). An example of an inquiry window 100 is shown in FIG. 3.

Figure 3:
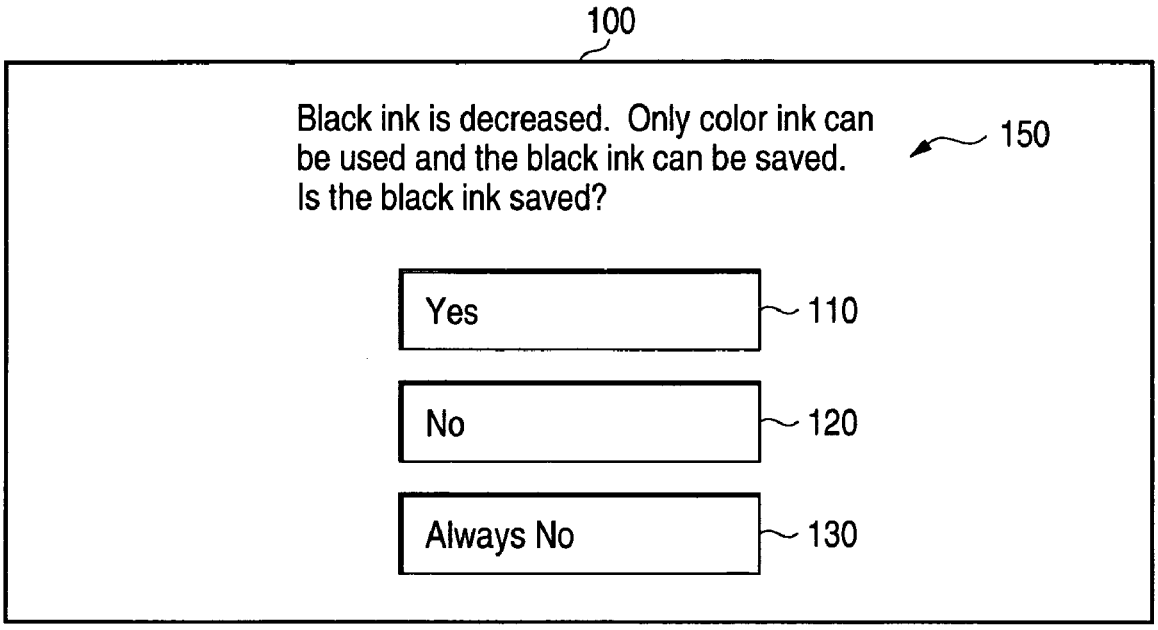
FIG. 3 shows one example of an inquiry screen for inquiring a user about whether or not the printing operation is carried out by composite black.

As shown in FIG. 3, on the inquiry window 100, a message 150 for inquiring the user about whether or not the printing operation is carried out by the composite black and buttons 110, 120 and 130 for receiving the desire of the user to the message are displayed. When the user desires to perform the printing operation by the composite black, the user presses the button 110. When the user does not desire to perform the printing operation by the composite black, the user presses the button 120. When the user does not completely desire to perform the printing operation by the composite black, the user presses the button 130, respectively.

Figure 2:
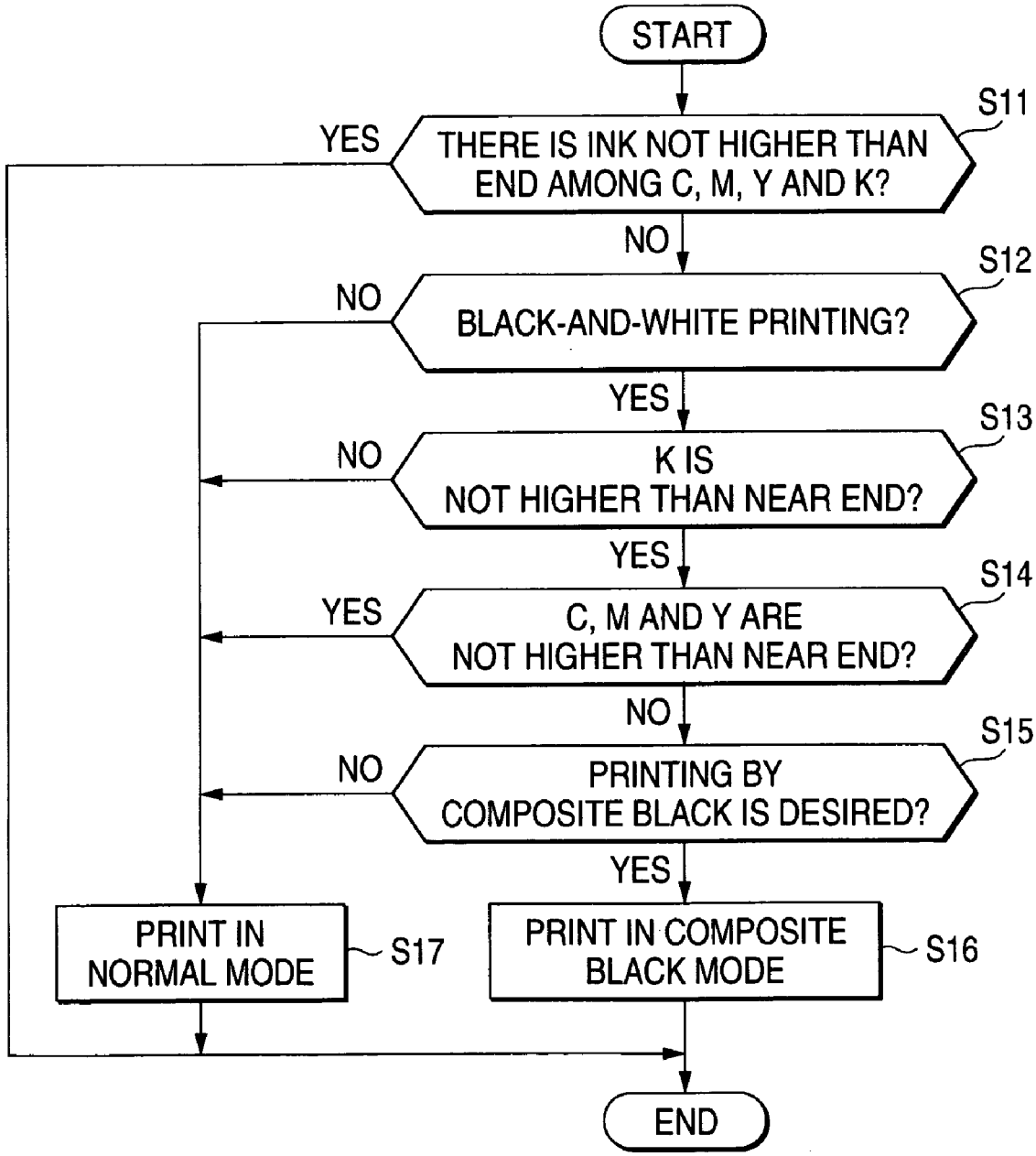
FIG. 2 is a flowchart showing a procedure when a print mode is decided to perform a printing operation.

Referring to FIGS. 2 and 3, when the user desires to perform the printing operation by the composite black, (the host device 1 receives that the button 110 is pressed on the inquiry window 100), the print mode deciding section 16 decides the print mode to be a composite black mode and informs the print data generating part 15 of the decision. The print data generating part 15 forms the print data in the composite black mode and transmits the formed print data to the printer 2 to perform the printing operation (S16).

On the other hand, when the user does not desire to perform the printing operation by the composite black (the host device 1 receives that the button 120 or the button 130 is pressed on the inquiry window 100), the printing operation is carried out in the normal mode (S17). When the button 130 is pressed, the printing operation is set to be constantly carried out under the normal mode until the ink cartridge 40 is replaced by a new cartridge and processes after the step S12 may be omitted.

The flowchart shown in FIG. 2 is summarized as described below.

(1) When the remaining amount of the black ink is higher than the near end, the printing operation is carried out in the normal mode.

(2) When the remaining amount of the black ink is not higher than the near end and the remaining amount of inks of all colors is higher than the near end, if the user desires, the printing operation is carried out in the composite black mode.

(3) When the remaining amount of the black ink is not higher than the near end and the remaining amount of one or more color inks is not higher than the near end, the printing operation is carried out in the normal mode.

In the state (1), the black ink is sufficiently contained in the ink cartridge 40 mounted in the mounting part 31. When the printer 2 is continuously used from this state and the black ink is relatively decreased more than the color inks to become the state (2), if the user desires, the printing operation is carried out in the composite black mode. That is, at the time of the state of (2), the user himself or herself can select whether the printing operation is performed by using the black ink or the printing operation is performed by saving the black ink depending on his or her will. Thus, the user can determine whether the printing operation is carried out in the composite black mode or the normal mode depending on whether or not there is a preliminary ink cartridge or what amount of data to be printed is left or the like.

When the printing operation is carried out in the composite black mode, the black ink is not used and the color inks are consumed, so that the consumption of the black ink is saved. Namely, in the state (2), it is detected that the black ink reaches the near end to save the consumption of the ink after that. Thus, the amount of ink necessary for maintenance or the like can be assured and the stable operation of the printer can be ensured. At the same time, the printing operation can be continuously carried out by the composite black.

When the printing operation is continuously carried out in the composite black mode under the state of (2), the remaining amount of the color inks is decreased to become a state of (3). Under the state of (3), the printing operation is always carried out in the normal mode. That is, in this embodiment, even when the printing operation is temporarily performed in the composite black mode, if the printing operation is carried out in the composite black mode, the printing operation will be returned again to the printing in the ordinary print mode. When the printing state becomes the state of (3), since the color inks and the black ink are likewise decreased, only the black ink does not need to be specially saved. Thus, the printing operation is performed in the normal mode. However, when the step S14 shown in FIG. 2 is omitted, if the user desires, the printing operation in the composite black mode will be continued. Thus, the color inks are consumed faster than the black ink.

The above-described embodiment of the present invention is illustrated for explaining the present invention and the scope of the present invention is not limited to the above-described embodiment. It is to be understood that a person with ordinary skill in the art can embody the present invention in other various forms without departing the gist of the present invention.

In the above described embodiment, the printing mode is changed from the normal mode of the black-and white printing to the black composite mode when the remaining amount of the black ink is not higher than the near end and the remaining amount of inks of all colors is higher than the near end and if the user desires. However, in the case that the cartridge is the one-cartridge type, the inquiry whether or not whether or not the printing operation is carried out by composite black may be made when the minimum remaining amount of ink among each color is not higher than the near end.

In the above described embodiment, the present invention is applied to the printing system in which the printer is connected to the host computer through the interface. The invention is not limited thereto. For example, the invention can also be applied to a standalone type printer which can directly receive the data stored in a memory card and a digital camera and performs printing. In this case, the inquiry window 100 may be displayed on an interface display such as liquid crystal display provided on the printer or a display of the digital cameral.

In the above described embodiment, when the remaining amount of the black ink reaches the near end, the composite black is generated with the color inks to continue printing. However, the invention can be applied so that single color ink is used instead of the black ink to continue printing when the remaining amount of the black ink reaches the near end, that is, the invention can be applied to a monocolor printing.

What is claimed is:

1. A printing system for performing a printing operation by using a plurality of various recording agents, comprising:

a detecting unit that detects a remaining amount of each of the plurality of various recording agents; and a printing unit that prints, if the remaining amount of a first one of the plurality of various recording agents is not higher than a first threshold value for warning a user against that the remaining amount of the first one is decreased and not lower than a second threshold value, data to be printed by using second one or ones of the plurality of various recording agents other than the first one, wherein the first threshold value allows the printing system to carry out the printing operation, and wherein the second threshold value prohibits the printing system from carrying out the printing operation.

2. The printing system according to claim 1, wherein the detecting unit monitors the remaining amount of each of the plurality of various recording agents, and when the detecting unit detects that the remaining amount of the first one reaches or is not higher than the first threshold value, the printing unit prints the data to be printed.

3. The printing system according to claim 1, wherein the first one is a black recording agent and the second one or ones are color recording agents.

4. The printing system according to claim 3, wherein if the detecting unit detects that the remaining amount of one of the plurality of the color recording agents is not higher than a third threshold value when printing using color recording agents substituting for black recording agent, the printing unit prints the data to be printed by using the black recording agent.

5. The printing system according to claim 1, wherein the printing system performs a maintenance consuming the plurality of various recording agents.

6. The printing system according to claim 4, wherein the printing system performs a maintenance consuming the plurality of various recording agents.

7. The printing system according to claim 1 further comprising:

a displaying unit that displays a screen for inquiring a user about whether or not the data to be printed by using the first one is printed by using the second one or ones without using the first one if the remaining amount of the first one is not higher than the first threshold value, wherein when an instruction for printing the data by using the second one or ones without using the first one is received, the print data generating unit generates the print data for printing the data to be printed using the second one or ones without using the first one.

8. A printer controller for controlling a printer for performing a printing operation by using a plurality of various recording agents, comprising:

an obtaining unit that obtains from the printer information showing a remaining amount of each of the plurality of various recording agents; and a print data generating unit that generates, if the remaining amount of first one of the plurality of various recording agents is not higher than a first threshold value for warning a user against that the remaining amount of the first one is decreased and not lower than a second threshold value, print data to be printed by using second one or ones of the plurality of various recording agents other than the first one, wherein the first threshold value allows the printer to carry out the printing operation, and wherein the second threshold value prohibits the printer from carrying out the printing operation.

9. The printer controller according to claim 8, wherein the detecting unit monitors the remaining amount of each of the plurality of various recording agents, and when the detecting unit detects that the remaining amount of the first one reaches or is not higher than the first threshold value, the printer prints the data to be printed.

10. The printer controller according to claim 8, wherein the first one is a black recording agent and the second one or ones are color recording agents.

11. A printer controller according to claim 8, wherein the first threshold value is determined on the basis of a difference between the remaining amount of the black recording agent and the remaining amount of the color recording agents.

12. The printer controller according to claim 8 further comprising:

a displaying unit that displays a screen for inquiring a user about whether or not the data to be printed by using the first one is printed by using the second one or ones without using the first one when the remaining amount of the first one reaches the first threshold value;

wherein when an instruction for printing the data by using the second one or ones without using the first one is received, the print data generating unit generates the print data for printing the data to be printed by using the second one or ones without using the first one.

13. A printer control method of controlling a printer for performing a printing operation by using a black recording agent and a plurality of color recording agents, the printer control method comprising steps of:

obtaining from the printer information showing a remaining amount of each of the plurality of various recording agents; and generating, if the remaining amount of a first one of the plurality of various recording agents is not higher than a first threshold value for warning a user against that the remaining amount of the first one is decreased and not lower than a second threshold value, print data to be printed by using second one or ones of the plurality of various recording agents other than the first one, wherein the first threshold value allows the printer to carry out the printing operation, and wherein the second threshold value prohibits the printer from carrying out the printing operation.

14. A computer readable recording medium that stores a computer program for a printer control, the computer program causing a computer comprising to execute the steps of:

obtaining from the printer information showing a remaining amount of each of the plurality of various recording agents; and generating, if the remaining amount of a first one of the plurality of various recording agents is not higher than a first threshold value for warning a user against that the remaining amount of first one is decreased and not lower than a second threshold value, print data to be printed by using second one or ones of the plurality of various recording agents other than the first one, wherein the first threshold value allows the printer to carry out a printing operation, and wherein the second threshold value prohibits the printer from carrying out the printing operation.

15. The computer readable recording medium according to claim 14 further comprising the step of:

transmitting the generated print data to the printer to perform the printing operation.

16. A printing method, comprising:

detecting a first amount of a first recording agent remaining in a first container;

detecting a second amount of a second recording agent remaining in a second container;

if the first amount of the first recording agent is less than a first threshold value and is greater than a second threshold value, printing data via a printing operation by using the second recording agent and by not using the first recording agent, wherein if the first amount of the first recording agent is less than the second threshold value, preventing the printing operation.

17. The printing method according to claim 16, wherein, if the first amount of the first recording agent is less than the first threshold value and is greater than the second threshold value, warning a user that the first amount of the first recording agent is low, and when the user inputs a command to preserve the first recording agent in response to the warning, printing the data via the printing operation by using the second recording agent and by not using the first recording agent.

* * * * *